United States Patent [19]

Conway et al.

[11] 4,067,366

[45] Jan. 10, 1978

[54] APPARATUS FOR FILLING CONTAINERS WITH LIQUID

[75] Inventors: Frank Horton Conway, Salisbury; Innis Raymond Myles, Allington, near Salisbury, both of England

[73] Assignee: The United States of America as represented by the Secretary of the Army, Washington, D.C.

[21] Appl. No.: 389,656

[22] Filed: Nov. 2, 1953

[51] Int. Cl.[2] ..... B65B 31/00

[52] U.S. Cl. ..... 141/59; 141/95; 141/198; 141/329

[58] Field of Search ..... 226/127 NG, 116, 127, 226/115, 111; 141/7, 8, 18, 56, 59, 95, 115, 119, 126, 172, 181, 198, 214, 225, 226, 284

[56] References Cited

U.S. PATENT DOCUMENTS

| | | | |
|---|---|---|---|
| 1,769,941 | 7/1930 | Miller | 141/18 |
| 1,842,134 | 1/1932 | Waite | 141/59 X |
| 2,660,350 | 11/1953 | Fechheimer | 141/126 |

FOREIGN PATENT DOCUMENTS

| | | |
|---|---|---|
| 394,409 | 6/1933 | United Kingdom. |

*Primary Examiner*—Harold Tudor
*Attorney, Agent, or Firm*—Nathan Edelberg; Robert P. Gibson

EXEMPLARY CLAIM

1. An apparatus for filling sealed containers with a predetermined quantity of liquid comprising a reservoir for the filling liquid, a separator container under vacuum, a filling nozzle having three orifices, one of the orifices having a pipeline connection to the separator, a second orifice having a pipeline connection to the separator and the third orifice having a pipeline connection to the atmosphere, said pipeline connection to the reservoir having a valve therein opening to a source of pressure and means for opening said valve when the desired amount of liquid has entered the sealed container.

12 Claims, 7 Drawing Figures

Figure 1:
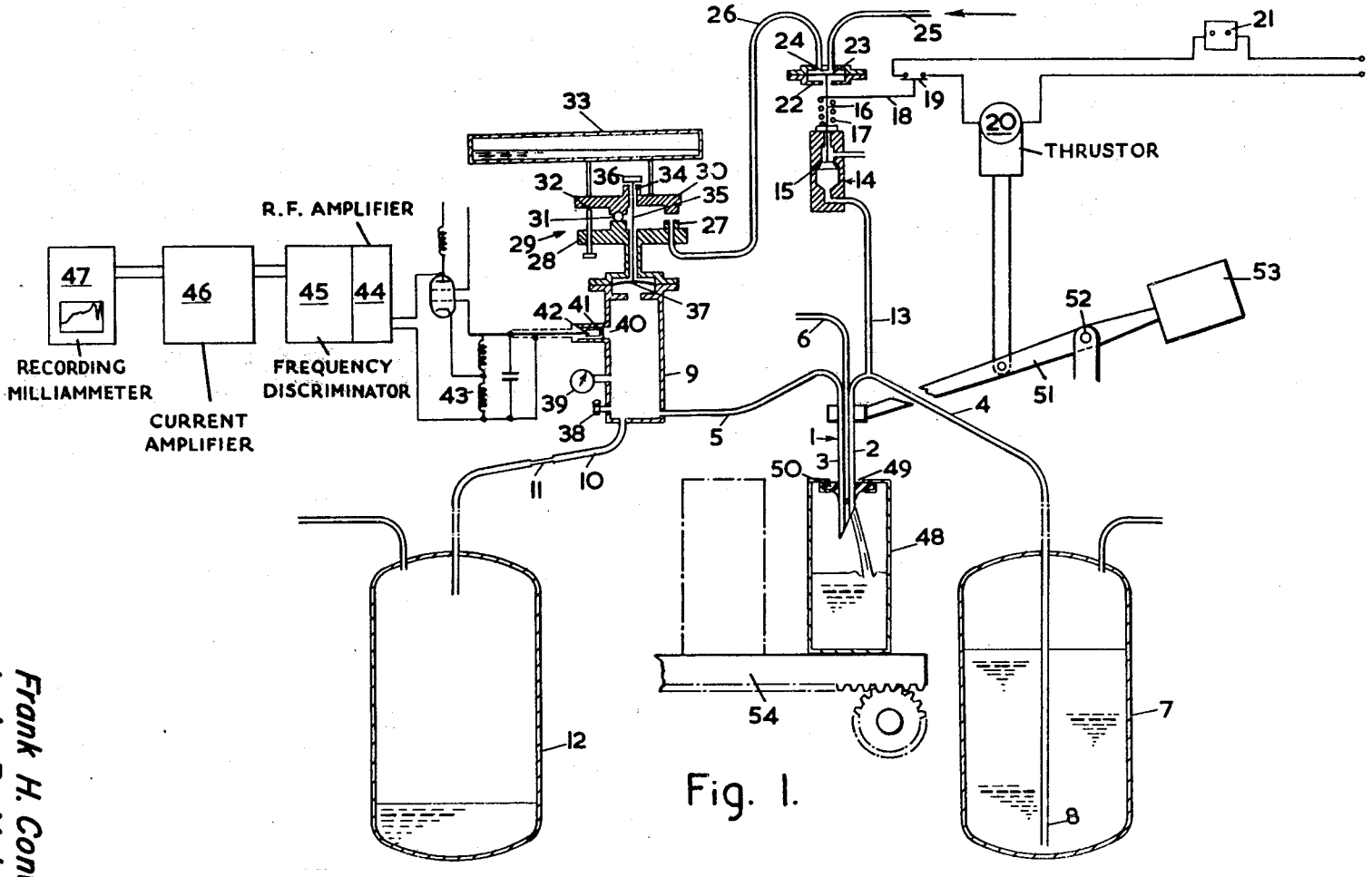
Figure 2:
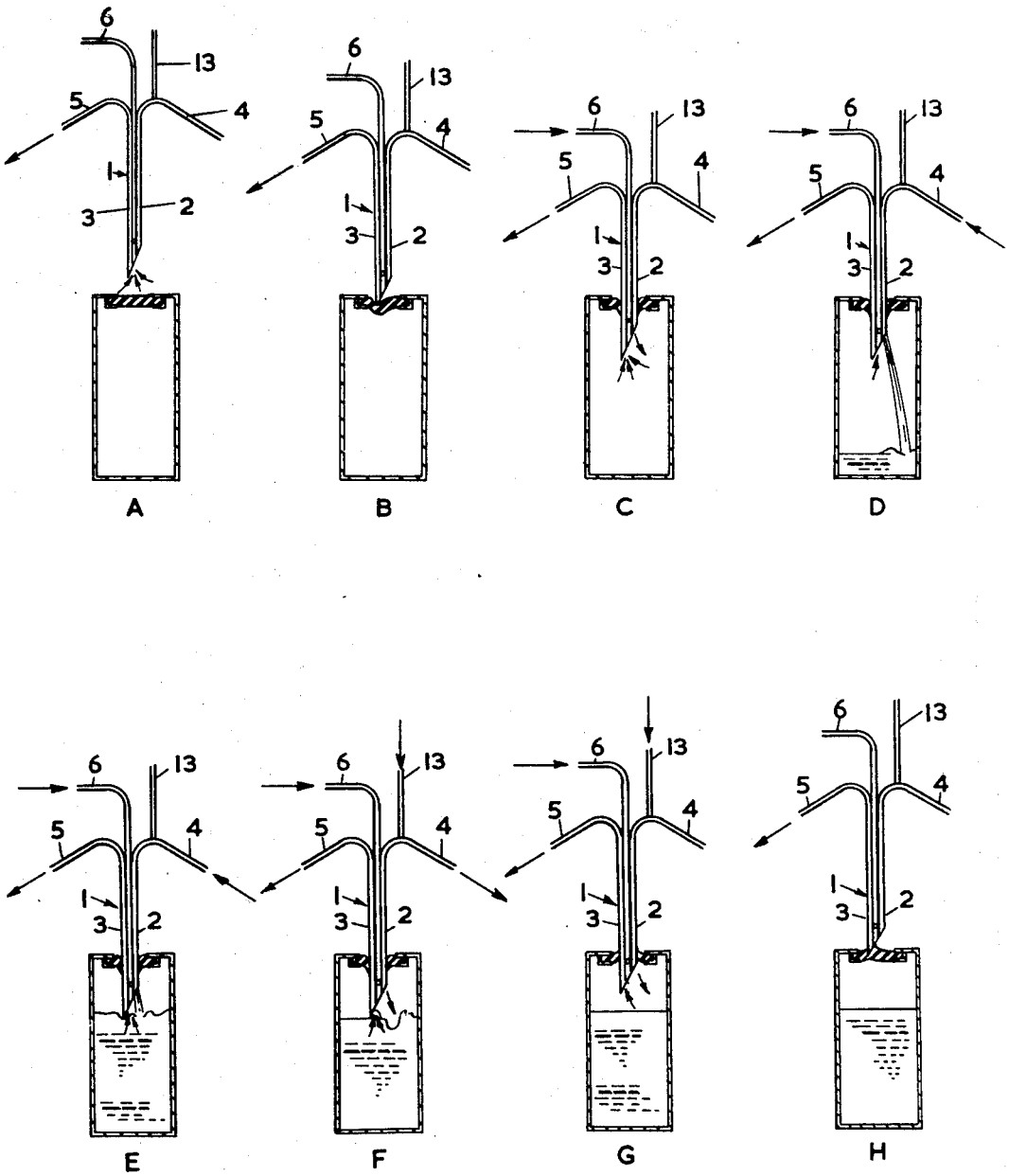

Frank H. Conway
Innis R. Myles
Inventor
By George Rinehart
Attorney

Frank H. Conway
Innis R. Myles
Inventor
By George Rinehart
Attorney

Frank H. Conway
Innis R. Myles
Inventor
By George Renchen
Attorney

Frank H. Conway
Innis R. Myles
Inventor
By George Rinehart
Attorney

APPARATUS FOR FILLING CONTAINERS WITH LIQUID

This invention relates to improved apparatus for filling containers with quantities of liquid. While not limited thereto the apparatus has particular application to the filling of containers with agents which are dangerous from toxic or other effects and to filling processes which are carried out under sterile operating conditions.

Hitherto it has been the practice to first fill containers by a constant depth method of filling and thereafter to inspect and test each container by a constant depth gauge or where highly toxic agents are being filled by electronic or other devices.

One object of the present invention is to provide an improved form of filling apparatus in which the filling and inspection processes are carried out simultaneously and in which a record of the filling operation on each container is retained.

A further object of the invention is to provide an improved device by which the end point of the filling operation is accurately determined and the supply of filling liquid automatically discontinued.

A still further object of the invention is to provide for the scouring of the walls of the filling nozzle with a view to eliminating drips from the filling nozzle when it is being withdrawn from the container being filled.

In accordance with the present invention the improved filling or charging apparatus comprises a reservoir for the filling liquid and a separator maintained under vacuum, each being connected by way of pipe lines to a filling head having an air or other gas bleed orifice and terminating in nozzles adapted to fit securely in an air-tight manner into the mouth of a container to be filled or adapted to enter a rubber septum or like closure positioned in the mouth of the said container, a control chamber, and an associated indicating or recording device being provided in the circuit between the filling head and separator whereby pressure variations during each filling operation are indicated or recorded for the purpose of determining a satisfactory filling of the container. As a result of experimental research it has been found that the absolute pressure values obtaining in the control chamber during the filling operation can be damped or controlled at reasonable steady values by the provision of a suitable restrictor in the conduit from the control chamber to the separator and by a suitable choice of an air bleed orifice in the filling head. The filling head may be mounted on an arm pivoted for vertical motion about a horizontal axis and actuated by an electro-hydraulic thrustor, pneumatic cylinder or other device so that it is automatically controlled by the control chamber whereby when the container is filled the energizing action of an electric circuit is broken and the filling head removed from the container.

In accordance with a further feature of the invention the variation in air pressure in the control chamber may be used to actuate a valve control mechanism adapted when the liquid in the container attains a height sufficient to cover the vacuum connected nozzle to operate a jet of air or other gas at or above atmospheric pressure to scour the filling nozzle of filling liquid. The air jet may be led into the filling pipe line so that the filling liquid, therein is split into two portions, the larger being forced to drain into the filling reservoir and the other expelled from the filling head into the container being filled whereby the filling nozzle is scoured and no internal drops of liquid remain within the nozzle. The withdrawal of the filling head through the rubber septum also serves to wipe off any filling liquid which may have splashed on to the outside of the nozzles. Thus adherence of any dangerous liquid on both the internal and external walls of the filling nozzle is eliminated after each filling operation so that any accumulation or subsequent dripping of liquid and the resulting contamination of the exterior of the container and its supports is avoided.

The invention will be described by way of example with reference to the accompanying drawings in which FIG. 1 shows diagrammatically the filling apparatus of the present invention.

FIGS. 2A – 2H illustrated the respective positions of the filling nozzle head and the flow of fluids into the container.

Figure 3:
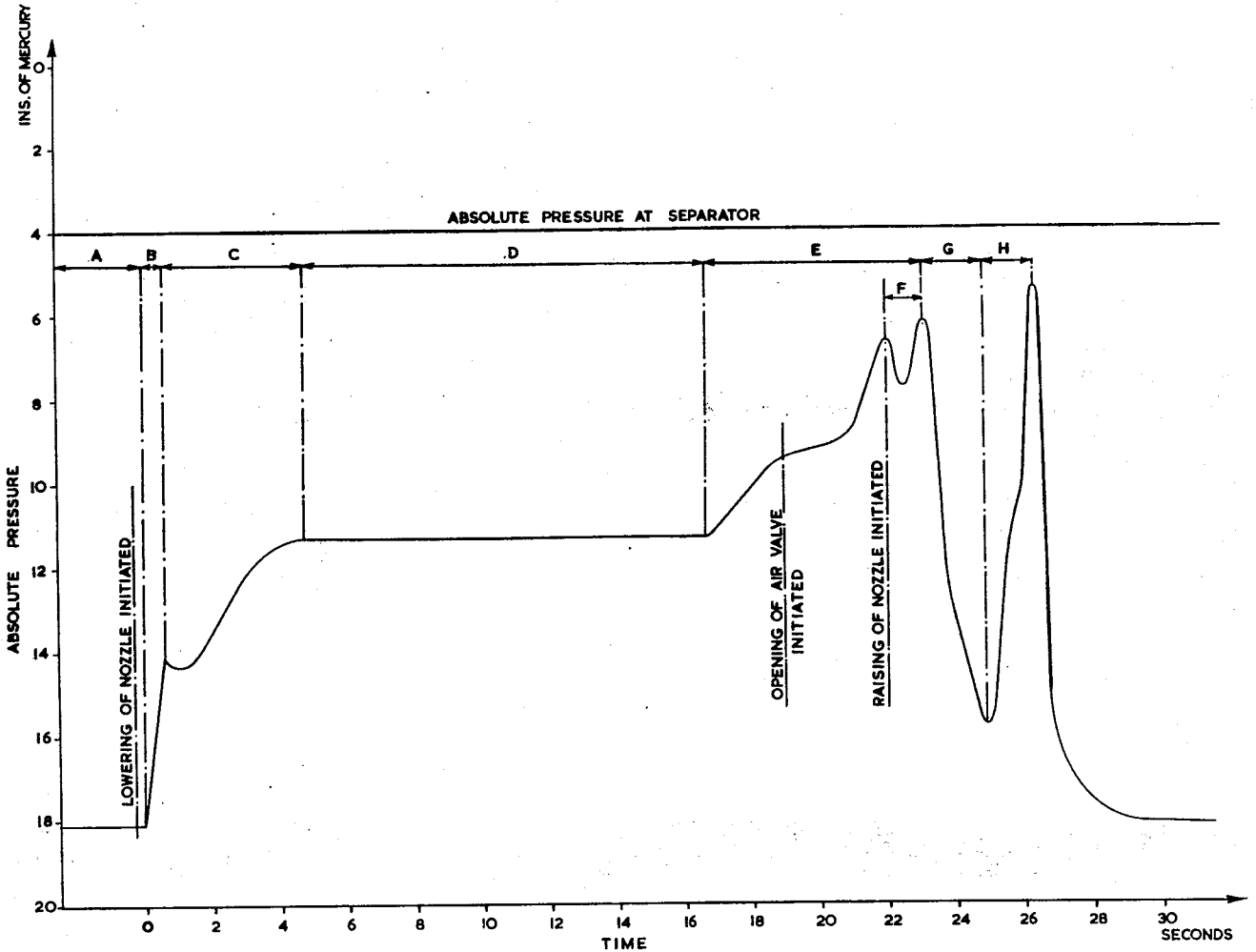

FIG. 3 shown graphically the variation in pressure values within the control chamber during the entire cycle of filling operations.

Figure 4A:
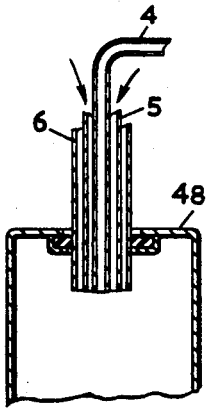
Figure 4B:
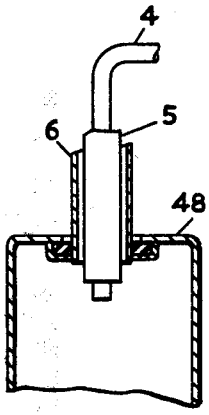
Figure 4C:
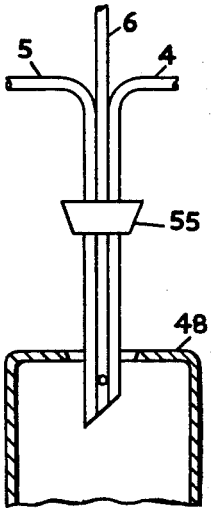

FIGS. 4*a* to 4*c* show further constructions of the filling head.

Figure 5:
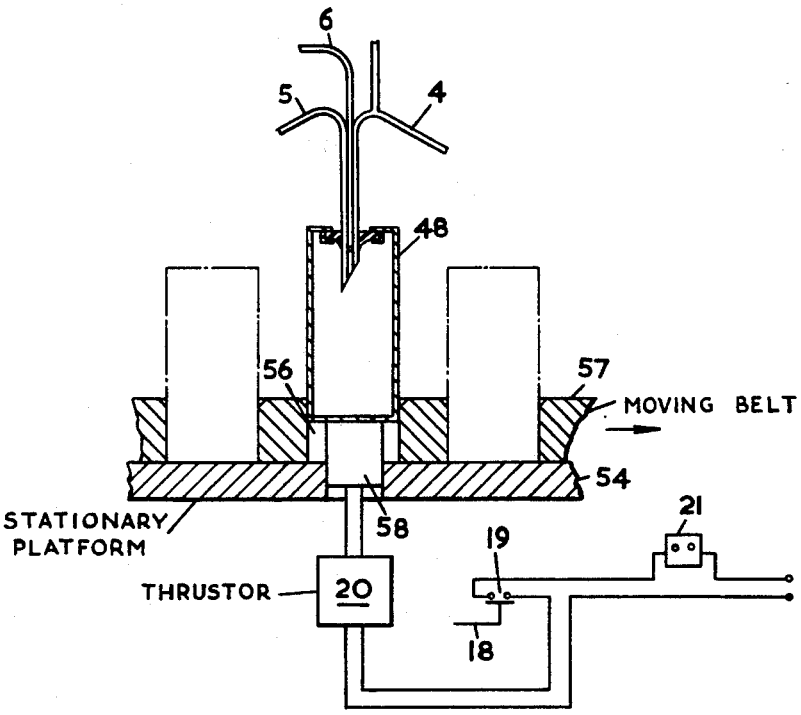

FIG. 5 illustrates an alternative means for obtaining relative motion between the filling head and consecutive containers.

Referring now to FIG. 1, the filling head 1 comprises two parallel nozzles 2 and 3 fixedly positioned in relation to one another and attached to flexible connecting tubes 4 and 5 respectively. These parallel nozzles 2 and 3 are joined together so as to terminate in an oblique pointed extremity and enclose between them a channelled air bleed 6 communicating with the atmosphere or with a sterile air supply under substantially atmospheric pressure at its upper end and extending down to an orifice situated in the lower wall of the nozzle combination. The connecting tube 4 is led down within a liquid reservoir 7 and terminates in a dip pipe 8. The other tube 5 is flexibly connected to a control chamber 9 which itself is connected by a tube 10, through a restrictor 11, to a controlled vacuum separator 12 connected to a vacuum pump (not shown) so that the air in the connecting tube 5 is always at a pressure lower than atmospheric. The filling head 1 is positioned at a higher level than both the liquid reservoir 7 and the controlled vacuum separator 12 so that gravity drainage ensues from the pipes 4 and 5 to the reservoir 7 and separator 12 respectively. Near the top of the delivery tube 4 a further flexible pipe 13 is connected to a valve unit 14 controlling a supply of gas at or above atmospheric pressure. This valve unit 14 is normally closed by a poppet valve 16 retained against a seat 15 by a compression spring 17 supported by the top of the valve casing and which is coaxial with the valve stem so that the spring 17 is free to expand or to contract to follow any corresponding movement of the poppet valve 16. A contacting arm 18 is rigidly attached to the stem of the poppet valve 16 to operate a normally closed switch 19 placed in series with an electro-hydraulic thrustor 20 and a press-button resetting switch 21. The thrustor 20 operates on an arm 51 which supports the filling head 1 and which is balanced about a fulcrum 52 by a counterpoised weight 53. The valve stem 16 passes into a diaphragmed vessel 22 and is connected to a diaphragm 23 which partitions off an air chamber 24. This air chamber 24 is connected by means of a delivery tube 25 to a source of air pressure and is also connected by means of a second tube 26 to an air nozzle 27 which extends through a base portion 28 of a modified Kelvin coupling 29. A balanced arm 30 of the coupling is hinged about a fulcrum 31 and, after tilting, either rests on an adjustable stop 32 on one side of the fulcrum or in contact with the nozzle 27 on the other. An arm 30 of the coupling supports a steelyard 33 which consists of a length of completely sealed tubing which is partially filled with mercury. On the nozzle side of the fulcrum 31 there is an aperture 34 in the balanced arm 30 and through this aperture passes a rod 35 enlarged at is upper end 36 and connected at its lower extremity to a diaphragm 37. This diaphragm is located across the upper portion of the control chamber 9, in the wall of which there is a test cock 38, a pressure gauge 39 and a walled aperture 40. This aperture 40 contains a diaphragm 41 which forms part of a variable condenser 42 included in an oscillating circuit 43 which connects with a pressure variation recording system. In a preferred recording system the oscillating circuit 43 connects with an R.F. amplifier 44 and discriminator 45. The discriminator is joined to a current amplifier 46 which is connected to a recording milliammeter 47.

Each container 48 to be filled with liquid is mounted on a power operated platform 54 and is provided with an end aperture 49 which is normally sealed by a rubber septum 50.

In use, a sealed container 48 is positioned below the filling head 1 and on pressing the button resetting switch 21 the electro-hydraulic thrustor 20 rotates the arm 51 and causes the filling head to descend so that the pointed nozzles 2 and 3 are caused to pierce the rubber septum 50 which formerly sealed off the container. The nozzles remain stationary inside the continer provided the thrustor circuit is not broken and in this position the rubber septum grips the nozzles and effectively seals off, as previously, the interior of the container from the atmosphere except for the effect of the air bleed aperture 6. The vacuum pump connected to the controlled vacuum separator 12 is now directly connected to the interior of the container 48 and thus the container 48 is evacuated to an absolute pressure controlled by the size of the air bleed 6. When the reduced pressure in the container is sufficient to overcome the effect of the liquid head liquid is induced through the dip pipe 8, along the connecting tube 4 and down through the nozzle tube 2 into the container 48 and this liquid flow continues so long as the syphon action, now established, is not severed. Any liquid droplets or other liquid carry-over which are induced into the vacuum circuit are deposited in the separator 12 and are retained. Liquid now flows freely into the container 48 until the level of the liquid therein rises to cover the bottom of the filling head 1 and thereafter the nozzle 3 becomes filled with liquid due to the reduced pressure in the controlled vacuum separator 12 and the closure of the air bleed aperture 6. This reduced pressure also acts downwardly on the diaphragm 37 connected to the rod 35, and a clock wise moment is imparted to the balanced arm 30 about its fulcrum 31. The sensitivity of the mechanism is such that the suction pressure on the diaphragm 37 is sufficient to tilt the balanced arm 30, which was previously set with an anticlockwise bias, in a clockwise direction before any appreciable quantity of liquid flows along the connecting tube 5. This tilting motion brings the balanced arm 30 to rest on the air nozzle 27 and the corresponding tilt given to the steelyard 33 causes a flow of mercury within it to the air nozzle end of the steelyard thus setting up a substantial turning moment due to the redistribution of the weight of the mercury from the fulcrum 31. This additional clockwise moment assists in effectively sealing the air nozzle 27.

Hitherto gas, at above atmospheric pressure, has been delivered into the tube 25 and after following the path of the connecting tube 26 it has been discharged to the atmosphere through the air nozzle 27. The upward exerting force of the spring 17 on the poppet valve 16 acts on the underside of the diaphragm 23 and besides counteracting the downward force of the air pressure on the upper face of the said diaphragm it maintains the switch 19 in its closed postion. When the tilting steelyard 33 finally closes this air nozzle 27 the build-up of pressure in the air chamber 24 acting upon the diaphragm 23 is controlled to compress the spring 17 and to force the poppet valve 16 off its seat 15 to allow air or other gas at or above atmospheric pressure to sweep down the delivery tube 13 and discontinue the liquid flow in the tube 2 by severing the syphoning action of the liquid. At the same time any residual liquid on the internal walls of the nozzle 2 are deposited into the container 48. The suction produced in the connecting tube 5 is sufficient to draw over, into the control chamber 9 and hence into the separator 12 any excess liquid which reaches the nozzle 3. Simultaneously with this action the contacting arm 18 which is rigidly fixed to the poppet valve 16 is pushed down and thereby caused to operate the switch 19 which breaks the electrical circuit and de-energizes the thrustor 20. This causes the filling head 1 to rise to its non-charging position by the action of a counter-balance weight. A suitable delay and subsequent speed of withdrawal of the filling head 1 can be regulated by hydraulic regulation of the thrustor 20 to allow the gas sweeping into the nozzle 2 to completely scour its internal surfaces whilst the filling head 1 is rising and being withdrawn through the rubber septum 50. The septum walls assist in reducing drip from the filling head by imparting a wiping action to the outside of the nozzles on its withdrawal.

As the filling head 1 lifts upwards from the septum it encounters a projection portion (not shown) of the balance arm 30 and tilts the arm in an anticlockwise direction and thus resets the coupling mechanism 29 in the tilted position ready for the next filling operation. The balanced arm 30 comes to rest on the stop 32 so that the air nozzle 27 is opened and the air passing through the delivery tube 25 is again allowed to pass freely through the connecting tube 26 and out of the air nozzle 27 to the atmosphere. The air pressure in the air chamber 24 is thus reduced and the resulting lifting of the poppet valve 16, under the influence of the spring 17, closes the valve and cuts off the supply of scouring air whilst simultaneously raising the contacting arm 18 and closing the switch 19. The whole sequence of operations has now been completed and a further operation of the press button resetting switch 21, which was disconnected due to the circuit breakage caused by the switch 19 opening, lowers the filling head 1 and commences a repetition of the filling operation.

During the above operation the velocity of the air in the connecting tube 5 is converted into control in the static pressure chamber 9 which controls the action of the air valve 14.

The restrictor 11, positioned along the tube 10, enables the pressure fluctuation to be made more pronounced.

The diaphragm 41 in the wall of the control chamber 9 actuates a variable pressure pick-up condenser 42 which provides an efficient pressure seal and which forms part of an R.F. oscillator circuit 43 in which any changes in capacitance causes corresponding changes in the frequency output of the oscillator. These changes in frequency are fed into an R.F. amplifier 44 and frequency discriminator 45 and the resulting currents conducted to a suitable current amplifier 46 operating a recording milliameter 47 which thus gives an indication of the pressure variations in the control chamber, and, as these variations are related to the various phases of the filling cycle, an operator, observing the current variation as shown on the milliameter recorder, can determine when the correct phases of the filling cycle have been carried out and when a container has been properly filled.

The variation in the absolute pressure values existing in the control chamber 9 may conveniently be divided into the following phases which operate from the instant when the filling head is about to pierce the rubber septum 50 and until the moment the nozzle orifices are withdrawn from it on the de-energisation of the thruster 20 and the raising of the nozzle head.

These phases, illustrating the movement of the filling head and the accompanying motion of fluids into the container 48 are shown in FIGS. 2A–2H and the pressure variations in the control chamber corresponding to these phases A to H are shown graphically on an absolute pressure – time curve at FIG. 3.

PHASE A in FIG. 3 shows the pressure inside the control chamber 9 before the filling head has penetrated the rubber septum into the container (FIG. 2A) and when air is drawn freely from the atmosphere into the nozzle 3 and conducted through the connecting tube 5 to the controlled vacuum separator 12. In this phase the air leakage into the connecting tube 5 is a maximum and this causes the highest absolute pressure which exists in the control chamber 9 during the entire filling operation.

PHASE B commences when the filling head starts to pierce the rubber septum 50. During this motion of the nozzles there is a momentary reduction on the absolute pressure to an extent dependent upon the nozzle piercing speed and on the volume of the circuit between the nozzle and the restrictor 11 since during the piercing action the nozzle orifices are partially closed by the walls of the septum.

PHASE C shows the nozzles completely inserted into the container which is initially filled with air at atmospheric pressure. The volume of air in the container 48 and in the tube circuits connected to the nozzle 2 now communicates with the nozzle 3 and momentarily increases the absolute pressure existing in the control chamber 9. Simultaneously the air bleed aperture 6 permits a small airbleed into the container and as the vacuum effect from the separator 12 overcomes the pressure increasing effect of the air bleed the absolute pressure in the container gradually reduces to a value which is lower than any of the previous phase values. At the end of this phase the difference in pressure between the air in the liquid reservoir 7 and in the container 48 is sufficient to overcome the line resistance in the delivery tube 4 and to establish the syphoning of the liquid from the supply reservoir into the container.

PHASE D commences as the liquid flows into the container, during which time the controlled vacuum separator 12 continues to withdraw air from the container and air is drawn into the container through the air bleed orifice. The pressure value becomes stabilised except for the effect of the gradual reduction in the quantity of air in the container as the liquid level rises, which effect gradually decreases the absolute pressure to a small extent during the period of liquid flow. The end of this phase occurs when the liquid level in the container covers the open end of the nozzle 3.

PHASE E is the period which commences when the liquid level reaches the open end of the nozzle 3 and causes it to be plugged with liquid with the result that the effect of the air bleed is eliminated and a still further absolute pressure reduction is caused in the control chamber 9. During this period of pressure reduction the syphoned liquid flow is broken by the tripping action of the coupling 29, and the subsequent opening of the air valve 14 allows a downrush of air in the valve delivery tube 13 to scour any remaining liquid from the nozzle 2. The end of this phase occurs when the minimum pressure has been reached within the filled container.

PHASE F is an intermediate phase of phase E and commences when the liquid level has risen in the container to a height sufficient to momentarily close the outlet of the nozzle 3. At this instant the nozzles commence to lift out of the container and a scouring downrush of air occurring in the valve delivery tube 13 causes a momentary increase in air pressure in the control chamber 9. This downward surge of air impinges on the liquid surface within the container and disturbs it thus causing liquid splashes which block the vacuum pipe and produce a decrease in absolute pressure in the control chamber.

PHASE G is the phase during which air is flowing freely down the nozzle 2 and also through the air bleed into the container. Simultaneously air is being drawn up the nozzle 3 and through the connecting tube 5 into the control chamber 9 so that the pressure in this chamber continues to rise throughout the phase. The maximum pressure value reached during this phase can be controlled by the pressure of the air passing through the valve 14 and entering the container through the nozzle 2 and also or alternately by the time during which the nozzles are allowed to remain in the container.

PHASE H corresponds to the period when the nozzles are being withdrawn and the orifices are passing through the rubber septum. Again, as in phase B, there is a momentary reduction in the absolute pressure within the control chamber since the walls of the septum partially close the nozzle tube orifice. The end of this phase and of the complete filling cycle occurs when the filling head has been raised altogether clear of the container and a full flow of air is drawn through the nozzle 3 to the control chamber 9.

This invention is not limited to the form of construction and particular embodiment described above. For instance the nozzles may have various constructional forms dependent upon the interior shape of the container and the initial liquid distribution required. In an alternative construction of the filling head, shown in FIG. 4*a*, the filling nozzle 4 may be enclosed by a concentric vacuum connected nozzle 5 and air bleed tube 6 so that the non-dripping quality of the head is improved. The construction may also allow relative movement between the nozzles which may be tubular and concentrically arranged so that during the filing operation the filling nozzle 4 is held clear of the end of the vacuum connected nozzle 5, as shown in FIG. 4*b*, so as to provide an improved liquid distribution and flow.

The use of the invention is not confined to employing sealed containers and is applicable also to the filling of open containers which may be closed during the filling operation by a suitably shaped block 55, concentric with, and, rigidly fixed to the filling head. Alternatively the containers may be partially closed by rubber septums which have an aperture of smaller diameter than that of a circular sectioned filling nozzle so that the relative movement between the nozzle and a septum on the withdrawal of the filling head causes a scouring action on the exterior surface of the nozzle.

Containers of various forms and capacities may be filled by setting the head for any required depth of insertion of the nozzle 3 into the container since this depth governs the amount of free space which is left within the container after filling.

The relative movement between the filling head and the container may be obtained by pneumatic, mechanical or other means and alternatively instead of lowering the nozzles into the containers 48 the latter may be mounted as shown in FIG. 5, in cupped receptacles 56 in a movable belt 57 supported on a filling platform 54, each container being lifted, on the operation of the thruster 20 to a fixed filling head as their said container is drawn by the belt into vertical alignment with a lifting piston 58 passing through the platform 54.

A feature of the invention is that the timing of the filling operation can be precisely determined and set, whilst the filling circuit still contains harmful liquids, by regulating the air bleed test cock 38, set in the wall of the control chamber 9, until the correct pressure value is obtained for operating the mechanism. During the adjustment any suitable form of closure may be used to temporarily seal the nozzle 3, whilst the test cock is regulated until the pressure reduction, occurring in the control chamber 9, is sufficient to draw down the diaphragm 37 and so tilt clockwise the balanced arm 30.

Normally air, at atmospheric pressure or above, may be used for scouring the filling nozzle 2 but when filling biological agents presterilized air or biologically inert gases such as carbon dioxide or nitrogen may be employed.

In the case of any operational failure when harmful liquids are being filled the whole apparatus may be simply decontaminated in situ by maintaining the filling head 1 down in its filling position within a container and then operating the filling process using a decontaminating liquid from a substituted reservoir supply.

The apparatus has been designed to allow a continuous and simultaneous inspection of the filling operation whilst it is being performed and provides an immediate indication of any filling irregularities. This simultaneous inspection is essential to detect any tilting of the Kelvin coupling and consequent scouring action and lifting of the filling head before a container has been correctly filled as might occur when an accidental blockage of the delivery tube 5 results in a decreased absolute pressure in the control chamber 9. To allow filling faults to be detected and diagnosized it is necessary to observe the pressure variations within the control chamber throughout the whole filling cycle and these can be simultaneously indicated and recorded during the filling process by a variety of accepted methods of instrumentation. In the simplest form of instrumentation the readings of the pressure gauge 39 may be observed and compared against a standard alternation of readings. Secondly the pressure variation may be mechanically recorded by directly connecting the control chamber to a pneumatic bellows fitted with a diaphragm which supports an indicating arm. Thus any movement of the diaphragm and hence of the indicating arm will be graphically recorded and will correspond with pressure variations in the control chamber. A more elaborate and accurate means of observing the irregularities in the filling operation consists in arranging the pressure impulses taken from the control chamber to influence the movement of the trace on a cathode ray tube and by placing in front of the cathode ray tube a transparent screen having an ideal filling trace characteristic marked on it, the departure of the filling trace from the ideal characteristic shows immediately any irregularity in the filling operation.

We claim:

1. An apparatus for filling sealed containers with a predetermined quantity of liquid comprising a reservoir for the filling liquid, a separator container under vacuum, a filling nozzle having three orifices, one of the orifices having a pipeline connection to the separator, a second orifice having a pipeline connection to the separator and the third orifice having a pipeline connection to the atmosphere, said pipeline connection to the reservoir having a valve therein opening to a source of pressure and means for opening said valve when the desired amount of liquid has entered the sealed container.

2. An apparatus in accordance with claim 1 including means for introducing the filling nozzle into the sealed container by penetration of the seal at the beginning of the filling cycle and to withdraw the nozzle at the completion of the filling cycle.

3. An apparatus in accordance with claim 1 comprising pressure sensitive means in the line between the filling nozzle and the separator, which means serves to actuate a recorder whereby pressure variations during each filling cycle are indicated and recorded.

4. An apparatus in accordance with claim 1 including a control chamber in the line from the nozzle to the separator, said control chamber including a pressure sensitive diaphragm which serves to open the valve in the line from the nozzle to the reservoir.

5. An apparatus in accordance with claim 4 wherein said control chamber includes two pressure sensitive means, the first of said means serves to open the valve in the line between the nozzle and the reservoir to the source of pressure when the pressure in the control chamber falls due to the covering of the vacuum orifice and bleed orifice in the filling nozzle, the second of said means serving to actuate a recorder whereby pressure variations during each filling cycle are indicated and recorded.

6. An apparatus in accordance with claim 1 wherein the orifices of the filling nozzle are arranged in descending order so that the rising fluid in the sealed container first contacts the vacuum nozzle.

7. An apparatus in accordance with claim 6 wherein the orifices of the filling nozzle are arranged so that the filling nozzle is highest, followed by the atmospheric bleeding nozzle and wherein the vacuum nozzle is lowest.

8. An apparatus in accordance with claim 1 wherein the valve in the pipeline connection to the reservoir is so positioned that its opening to a source of pressure at the completion of the filling operation causes the liquid in the filling line to split into two portions, the larger portion being forced to drain into the filling reservoir and the other being expelled through the filling nozzle into the container being filled.

9. An apparatus for filling sealed containers with a predetermined quantity of liquid, comprising a triple orifice filling head arranged to penetrate and fit securely in an air tight manner in the seal of each container to be filled, a vacuum producing means connected to one orifice of said filling head to produce a partial vacuum in the container during the filling operation, a liquid supply reservoir connected to a second orifice and a vent to the atmosphere being connected to the third orifice of said filling head, a valve in the circuit between the filling head and the liquid supply reservoir, said valve opening to a source of pressure, a control chamber in the circuit between the filling head and the vacuum producing means, said chamber including means responsive to the pressure variation during each container filling operation which operates to discontinue the supply of liquid and to withdraw the filling head from the container when the liquid rises to cut off the orifices in the filling head.

10. An apparatus in accordance with claim 9 wherein said control chamber includes a pressure operated indicating device that serves to make a record of pressure variations during a filling operation.

11. An apparatus in accordance with claim 9 wherein electro-hydraulic means serve to introduce and withdraw the filling head from the sealed container, said means being controlled by the gas pressure in the control chamber.

12. An apparatus in accordance with claim 9 wherein the containers to be filled are consecutively positioned on a filling platform situated below the filling head and are moved into alignment with a lifting mechanism operated by the gas pressure in the control chamber to consecutively lift the containers to receive the filling head and to lower them from the said head when the said containers are filled with liquid.

* * * * *